United States Patent [19]

Kvas et al.

[11] Patent Number: 4,561,210

[45] Date of Patent: Dec. 31, 1985

[54] SLIDING DOOR

[76] Inventors: Peter J. Kvas, 81 Wychcrest Ave., Toronto, Ontario, Canada, M6G 3X8; Claudio Fera, 444 Clinton St., Toronto, Ontario, Canada, M6G 2Z2

[21] Appl. No.: 581,820

[22] Filed: Feb. 21, 1984

[51] Int. Cl.[4] ..... E05D 15/06

[52] U.S. Cl. ..... 49/372; 49/410; 49/449; 49/504

[58] Field of Search ..... 49/372, 411, 410, 409, 49/377, 449, 504, 505; 292/251.5

[56] References Cited

U.S. PATENT DOCUMENTS

| | | | |
|---|---|---|---|
| 2,561,079 | 7/1951 | Trammell, Sr. | 49/372 |
| 2,818,608 | 1/1958 | Lawrence, III | 49/372 X |
| 2,840,408 | 6/1958 | Scott et al. | 292/251.5 |
| 3,058,174 | 10/1962 | Sterling | 49/372 |
| 3,222,833 | 12/1965 | Woodrum | 49/505 X |
| 3,348,337 | 10/1967 | Grasso | 49/410 X |
| 3,727,349 | 4/1973 | Bainbridge | 49/411 |
| 3,859,754 | 1/1975 | Budich et al. | 49/504 X |
| 4,058,951 | 11/1977 | Dean | 49/504 |
| 4,308,692 | 1/1982 | Rumble et al. | 49/504 |
| 4,467,562 | 8/1984 | Hemmerling | 49/411 |

FOREIGN PATENT DOCUMENTS

| | | | |
|---|---|---|---|
| 1281396 | 7/1972 | United Kingdom | 49/372 |

*Primary Examiner*—Philip C. Kannan

[57] ABSTRACT

A sliding door assembly for use in a double-panelled wall construction, in which the door is suspended on a hanger assembly having a pair of spaced vertical posts and a horizontal rail supported by the posts. Rollers in the plane of the door engage the rail, which hangs the door on the rail for sliding into the cavity between the wall panels.

15 Claims, 8 Drawing Figures

SLIDING DOOR

FIELD OF THE INVENTION

This invention relates to a sliding door for use in double-panelled walls, for example, in intramural drywall construction.

BACKGROUND OF THE INVENTION

Sliding doors which disappear within a wall when opened, called pocket doors, are sometimes used in the internal walls of buildings. Such doors usually use a double overhead rail or a wide single rail which requires a wall cavity of considerable width. Such constructions are not suitable for thinner double-walled partitions such as those used to divide floorspace into individual offices.

It is an object of the invention to provide a sliding door assembly suitable for use in the cavities of thinner double-panelled walls such as inter-office partitions.

SUMMARY OF THE INVENTION

Essentially the invention consists of a sliding door assembly for use in a wall construction having a pair of spaced panels forming a wall cavity, comprising: a hanger assembly having a pair of spaced vertical posts and a horizontal rail supported at each end by the posts; and a door having the upper portion thereof carrying roller means lying in the plane of the door and engaging the rail, whereby the door is slidably hung on the rail for movement in the wall cavity the door comprising a pair of spaced parallel panels and the roller means comprising a pair of spaced rollers journally mounted between the panels.

In another aspect the invention consists of a sliding door assembly for use in a wall construction having a pair of spaced panels forming a wall cavity, an upper stringer, a lower stringer and vertical studs, the panels having opposed door openings, comprising: a hanger assembly located in the wall cavity and having a pair of spaced vertical posts each resting on the lower stringer and a horizontal rail supported at each end thereof by the posts; a door having at the top portion thereof roller means engaging the rail whereby the door is slidably hung on the rail for movement in the well cavity, the door comprising a pair of spaced parallel panels and the roller means comprising a pair of spaced rollers journally mounted between the panels; an elongated member bridging the posts above the rail, and two rows of spaced parallel auxiliary studs interconnecting the elongated member and the lower stringer one row on each side of the rail.

DESCRIPTION OF THE DRAWINGS

An example embodiment of the invention is shown in the accompanying drawings in which.

DESCRIPTION OF PREFERRED EMBODIMENT

Figure 1:
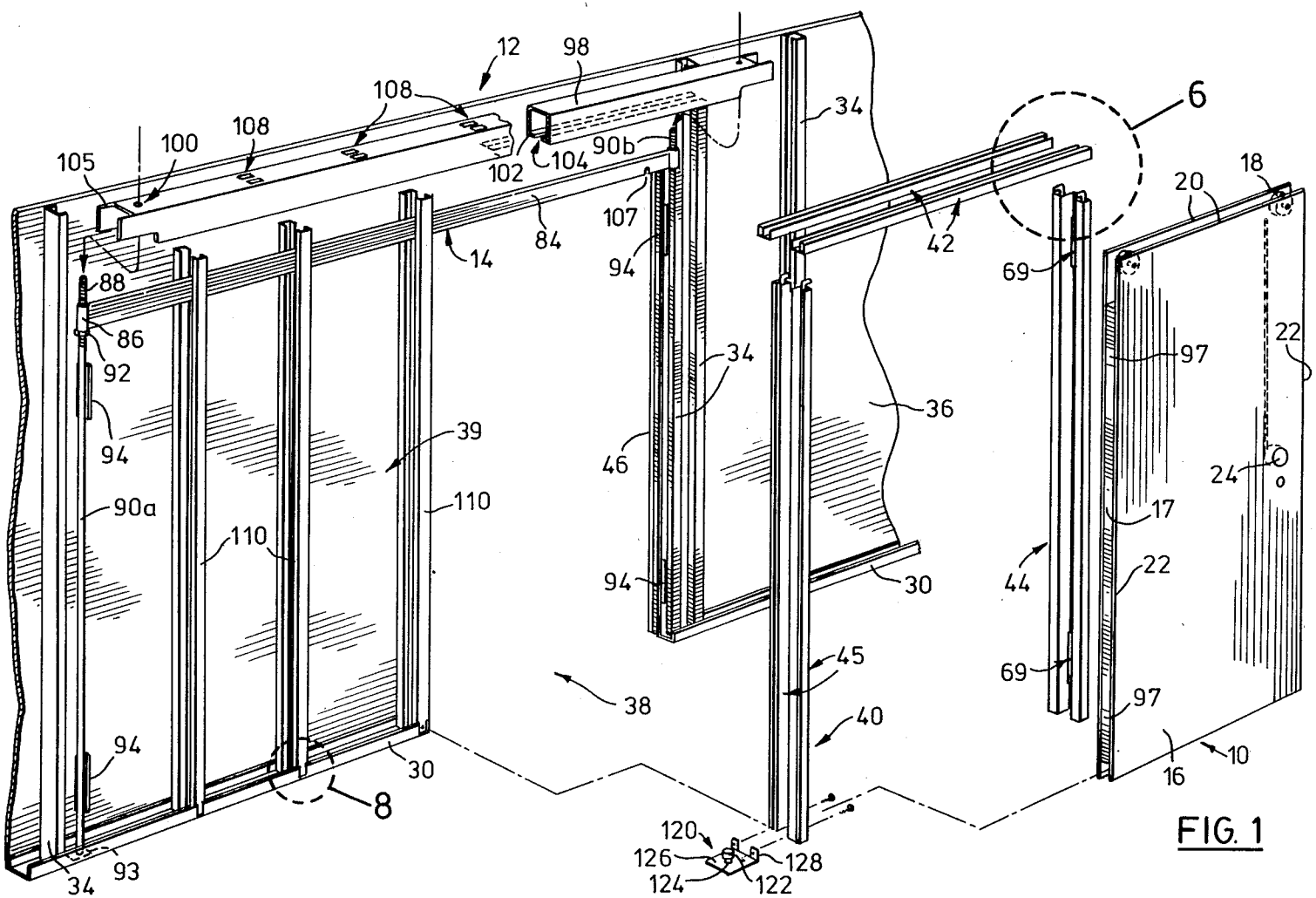
FIG. 1 is an exploded perspective view of a sliding door and its associated hanger.

The example of embodiment shown in the drawings consists of a sliding door 10 supported in a wall on a hanger assembly 14.

Door 10 comprises a pair of parallel planar panels 16 separated by a spacer 17 to accommodate a pair of rollers 18 journally mounted on the panels adjacent the top edges 20 of the panels, one adjacent each side edge 22, above spacer 17. Door 10 may carry, between panels 16, a lock 24 having a vertical lock bolt 26.

Wall 12 is of drywall construction comprising a horizontal bottom channel stringer 30 and a horizontal top channel stringer 32 and between them a row of spaced vertical studs 34 supporting and separating a pair of drywall panels 36. Matched door openings 38 are located in panels 36 approximately the size of door 10. Studs 34 in the vicinity of openings 38 are removed to form a pocket 39 in wall 12 to accommodate door 10 and hanger assembly 14.

Figure 6:
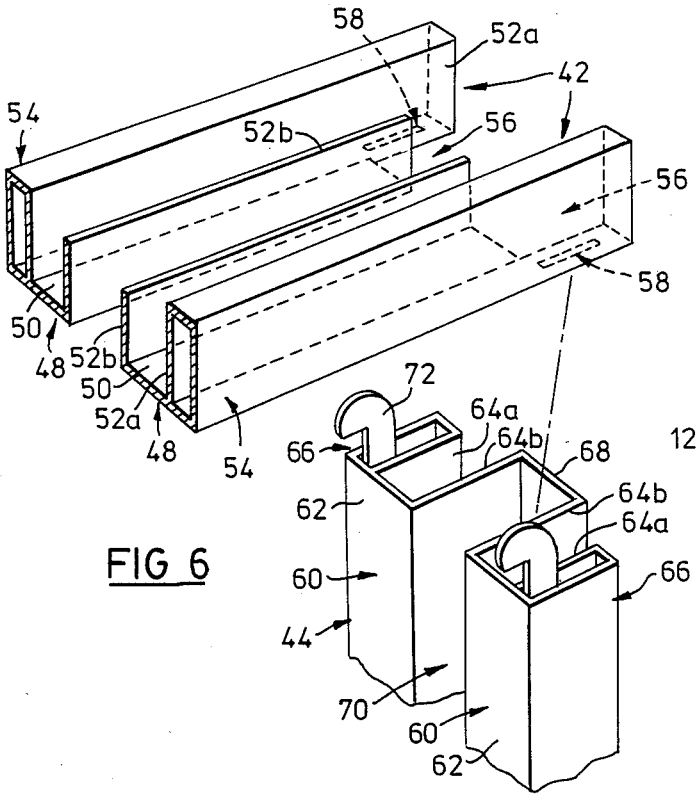
FIG. 6 is an enlargement of the headers and jambs of the trim frame indicated by broken circle 6 in FIG. 1.

Openings 38 of drywall panels 36 have a trim frame 40 which consists of two horizontal headers 42, a double vertical jamb 44 and a pair of vertical jambs 45, all of which fit over edges 46 of panels 36 forming openings 38 to trim the openings. As seen more particularly in FIG. 6, each header 42 comprises a channel member 48 having a web 50 together with flanges **52*a* and 52*b*, flange 52*a* being integral with a box member 54. Each end of web 50 of channel 48 has cut-out portion 56 adjacent box member 54 for receiving a panel 16 of door 10 and a longitudinal slot 58 in box 54. Jamb 44 comprises a pair of channel members 60 each having a web 62 interconnecting flanges 64*a* and 64*b*, flange 64*a* being integral with an outer box member 66 and flange 64*b* being interconnected by a further flange 68 to form a recess 70 in the jamb. Jambs 45 are similar to jamb 44 but channel members 60 are not interconnected. Projecting from the upper end of box members 66 of jambs 44 and 45 are hooks 72 adapted to be received by slots 58 in each end of headers 42. Web 68 has a pair of vertical slots 69**.

Figure 3:
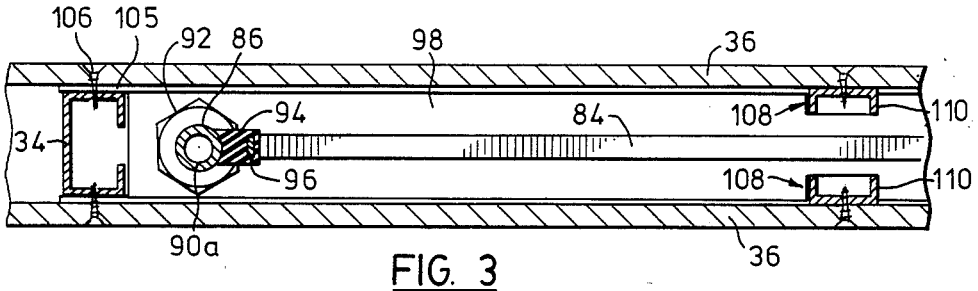
FIG. 3 is a cross-sectional view taken along line 3—3 of FIG. 2.
Figure 4:
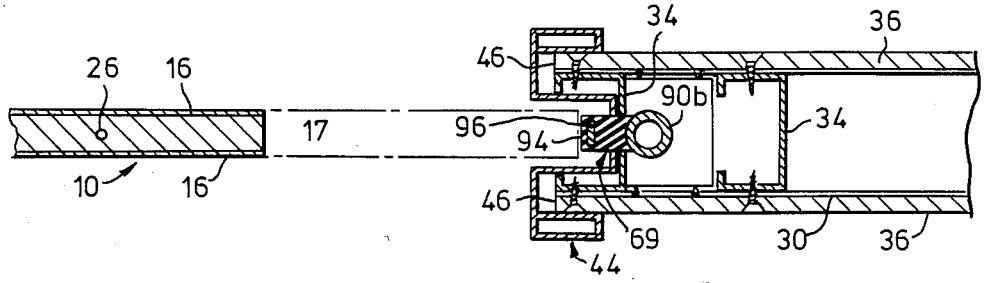
FIG. 4 is a cross-sectional view taken along line 4—4 of FIG. 2.
Figure 8:
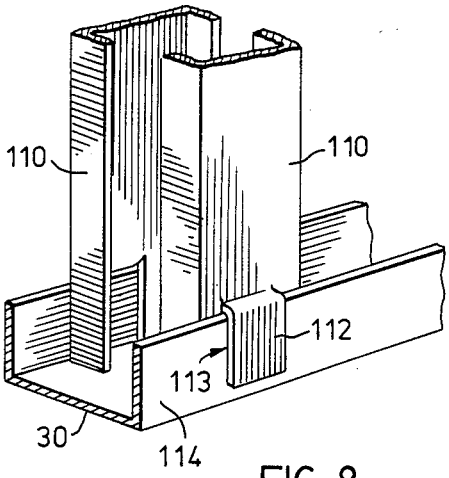
FIG. 8 is an enlargement of the base of the stud and its associated stringer indicated by broken circle 8 in FIG. 1.

Hanger assembly 14, located in pocket 39 of wall 12, comprises a rail 84 having a smooth-bore boss 86 at each end which receive the threaded upper end portions 88 of a pair of vertical support posts **90*a*, 90*b*, the height level of each boss on its associated post being adjustable by a nut 92 threaded on the upper end portion of each post. Each post 90*a*, 90*b* carries a base plate 93 which is fastened to stringer 30 and also a pair of spaced, resilient bumper stops 94 with a permanent magnet 96 embedded in each stop to engage with a metal piece 97 correspondingly located in spacer 17 of door 10. Slots 69 in jamb 44 receive bumper stops 94 of post 90*b*. An inverted channel member 98 is mounted on posts 90 which engage threaded holes 100 one adjacent each end of the channel member. A pair of inturned flanges 102 on channel member 98, in the region of openings 38, define a longitudinal slot 104. Pairs of flanges 105 at each end of channel member 98 are secured to studs 34 by drywall screws 106 (see FIG. 3). A notch 107 is located in rail 84 to receive the upper end of lock bolt 26** when door 10 is closed. Spaced slots 108 in the top wall of member 98 receive the upper end portions of two opposed rows of spaced auxiliary or pocket studs 110. As seen in FIG. 8, each pocket stud 110 is a channel member and has a lip 112 adjacent its lower end defining a slot 113 which receives the upstanding flange 114 of stringer 30 to anchor the stud.

Figure 7:
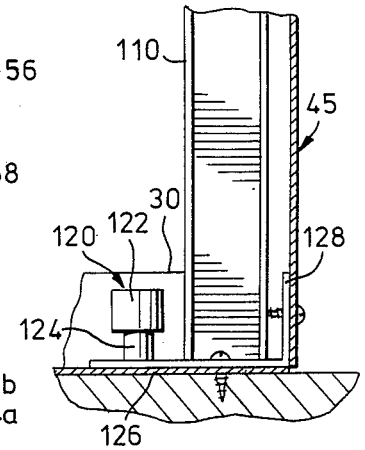
FIG. 7 is an elevational view of the roller guide at the base of one pair of jambs of the trim frame.

A roller guide 120 is located in stringer 30 and fixed to the bottom of stringer 30 adjacent openings 38, as shown in detail in FIG. 7. Roller guide 120 consists of a roller 122 journally mounted on a vertical post 124 fixed to a plate 126 having a pair of upturned flanges 128 which are fixed to the bottom ends of vertical jambs 45.

Figure 2:
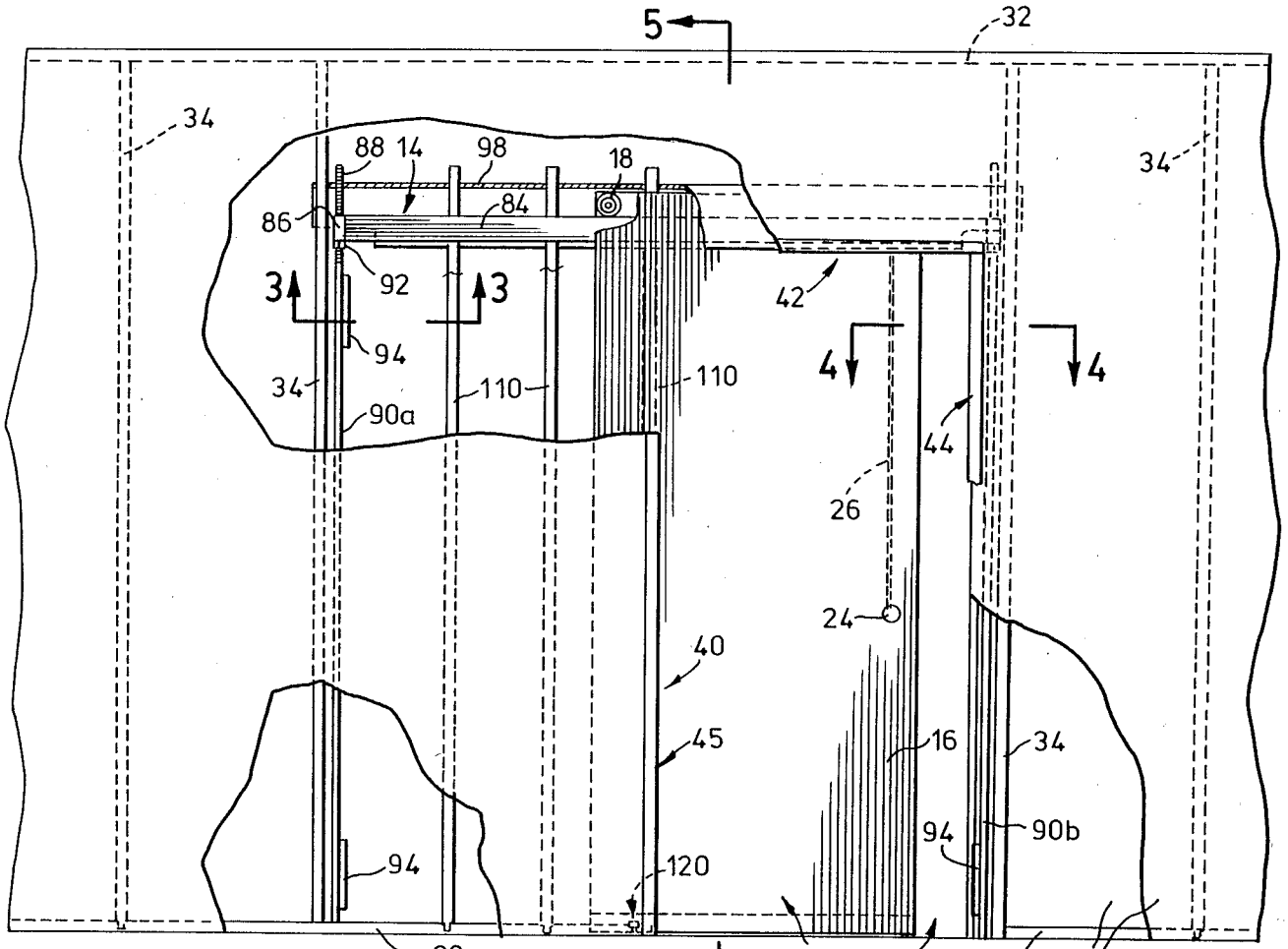
FIG. 2 is a view in elevation, partly broken away, of the door and hanger of FIG. 1.
Figure 5:
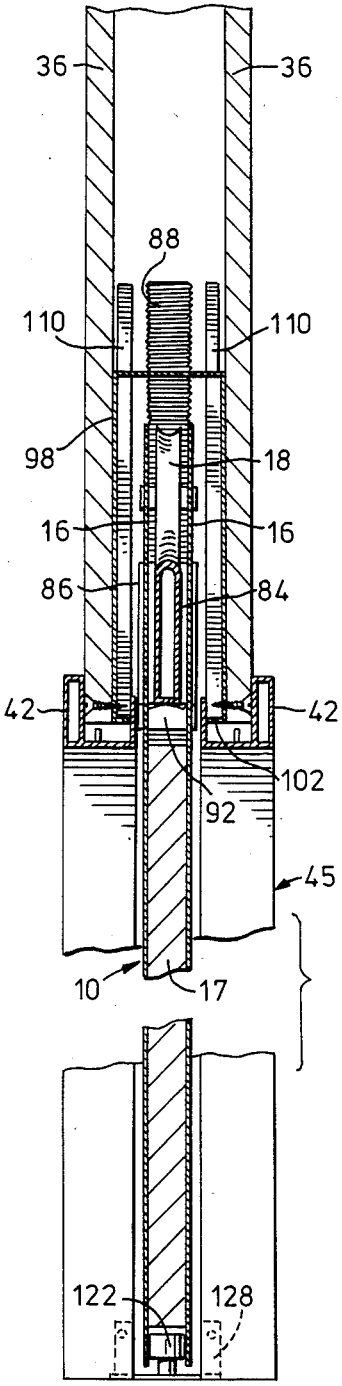
FIG. 5 is a cross-sectional view taken along line 5—5 of FIG. 2.

Rollers 18 of door 10 engage rail 84, as seen in FIGS. 2 and 5, to hang the door which is slidable from a fully closed position between openings 38, where the door abuts bumpers 94 on post 90*b*, to a fully open position, where the door abuts bumpers 94 on posts 90*a*. FIG. 2 shows door 10 in a partially open position. At all times roller guide 120 engages panels 16 of door 10 below spacer 17.

It will be appreciated that the sliding door of the invention may be incorporated into any double wall, i.e. a wall having a pair of parallel, spaced wall panels with a cavity between the panels, the described embodiment being a more particular construction for use with drywall panels. Door 10 can be of any suitable construction, for example it could be a solid door grooved along its upper edge to accommodate rollers 18 and along its lower edge to accommodate guide roller 122. Alternately, for example, rollers 20 could be mounted on door 10 by means of brackets.

We claim:

1. A sliding door assembly for use in a wall construction having a pair of spaced panels forming a wall cavity, comprising:

a hanger assembly having a pair of spaced vertical posts and a horizontal rail supported at each end thereof by the posts; and a door having the upper portion thereof carrying roller means engaging the rail, whereby the door is slidably hung on the rail for movement in the wall cavity, the door comprising a pair of spaced parallel panels and the roller means comprising a pair of spaced rollers journally mounted between the panels.

2. An assembly as claimed in claim 1 in which the door carries a vertical sliding lock bolt and the rail has a recess therein, the bolt being engagable in the recess when the door is in a closed position.

3. An assembly as claimed in claim 1 in which the rail carries a boss at each end thereof and each post comprises a rod threaded at the upper end portion to receive a threaded nut, the post being receivable in the boss with the boss resting on the nut.

4. An assembly as claimed in claim 1 in which each post carries at least one resilient bumper positioned to be contacted by the sliding door.

5. An assembly as claimed in claim 4 including magnet means positioned in said bumper to hold the door releasably thereagainst.

6. A sliding door assembly for use in a wall construction having a pair of spaced panels forming a wall cavity, an upper stringer, a lower stringer and vertical studs, the panels having opposed door openings, comprising:

a hanger assembly located in the wall cavity and having a pair of spaced vertical posts each resting on the lower stringer and a horizontal rail supported at each end thereof by the posts;

a door having at the top portion thereof roller means engaging the rail, whereby the door is slidably hung on the rail for movement in the wall cavity, the door comprising a a pair of spaced parallel panels and the roller means comprising a pair of spaced rollers journally mounted between the panels;

an elongated member bridging the posts above the rail, and two rows of spaced parallel auxiliary studs interconnecting the elongated member and the lower stringer one row on each side of the rail.

7. An assembly as claimed in claim 6 in which the elongated member comprises an inverted channel member having a horizontal top wall with a plurality of slots therein, the upper end portions of the auxiliary studs being receivable in the slots.

8. An assembly as claimed in claim 6 including means at each end of the elongated member connectable to the studs.

9. An assembly as claimed in claim 6 including guide roller means positioned on the lower stringer and engagable with the door between the panels thereof.

10. An assembly as claimed in claim 6 in which the lower stringer is a channel with upstanding side walls, each auxiliary stud abutting an upstanding side wall of said lower stringer and having an outstanding flange integral therewith forming a slot receiving said upstanding side wall.

11. An assembly as claimed in claim 6 in which each post carries at least one resilient bumper positioned to be contacted by the door to define the limit of each end of travel of the door along the rail, and magnet means embedded in each bumper to hold the door releasably at either limit of travel.

12. An assembly as claimed in claim 6 including a trim frame mounted on the door openings, the trim frame comprising a pair of horizontal headers, a pair of first interconnected vertical jambs and a pair of second vertical jambs, and means receivable to interconnect the headers and the jambs.

13. An assembly as claimed in claim 12 in which the means to interconnect the headers and the jambs comprise a slot adjacent each end of each header and hook means carried by the jambs receivable in the slots.

14. An assembly as claimed in claim 12 in which each vertical jamb comprises a channel member having a web interconnecting a pair of flanges, one flange having a box member integral therewith.

15. An assembly as claimed in claim 12 in which each header comprises a channel member having a web interconnecting a pair of flanges, each flange having a box member integral therewith.

* * * * *